US010099889B1

(12) United States Patent
Huang

(10) Patent No.: US 10,099,889 B1
(45) Date of Patent: Oct. 16, 2018

(54) STRING SERVING JIG

(71) Applicant: Dorge O. Huang, Henry, IL (US)

(72) Inventor: Dorge O. Huang, Henry, IL (US)

( * ) Notice: Subject to any disclaimer, the term of this patent is extended or adjusted under 35 U.S.C. 154(b) by 331 days.

(21) Appl. No.: 15/195,066

(22) Filed: Jun. 28, 2016

(51) Int. Cl.
*B65H 59/00* (2006.01)
*B65H 59/04* (2006.01)
*B65H 49/32* (2006.01)

(52) U.S. Cl.
CPC ..... *B65H 59/04* (2013.01); *B65H 49/32* (2013.01); *B65H 2405/42* (2013.01); *B65H 2701/35* (2013.01)

(58) Field of Classification Search
USPC ..... 242/439.2, 439.3, 442; 57/3, 10
See application file for complete search history.

(56) References Cited

U.S. PATENT DOCUMENTS 2,906,086 A * 9/1959 Wilson ..... D07B 7/16 57/1 R
3,024,017 A * 3/1962 Stanton ..... F41B 5/1446 269/38
4,974,576 A * 12/1990 Morey ..... F41B 5/14 124/1
4,982,560 A * 1/1991 Vives ..... B65H 81/08 242/439
6,321,519 B1 * 11/2001 Goertz ..... A44C 27/00 57/11
9,633,573 B1 * 4/2017 Tafoya ..... G09B 19/0038
2007/0278339 A1 * 12/2007 McMahan ..... F41B 5/14 242/439
2012/0085854 A1 * 4/2012 Blosser ..... F41B 5/1411 242/439

* cited by examiner

*Primary Examiner* — Emmanuel M Marcelo
(74) *Attorney, Agent, or Firm* — Donald J. Ersler

(57) ABSTRACT

A string serving jig preferably includes a frame, a quick change spool, a first spindle, a second spindle and a third spindle. The frame preferably includes a first half frame and a second half frame. The quick change spool preferably includes a spool reel, a spool spindle, a spool drive, a drag cup, a plurality of friction washers, a drag cover, a spool lock plate and a spool knob. The spool drive preferably includes a tubular shaft, a flange plate and a pair of drive pins. An even number of drive holes are formed in one of the two opposing flanges to receive the pair of drive pins. The drag cup includes a washer bore to receive the plurality of friction washers. The drag cover preferably includes a cup counter bore, which is sized to receive an outer perimeter of the drag cup.

18 Claims, 5 Drawing Sheets

STRING SERVING JIG

BACKGROUND OF THE INVENTION

1. Field of the Invention

The present invention relates generally to archery and more specifically to a string serving jig, which provides consistent tension when wrapping a bowstring with serving string.

2. Discussion of the Prior Art

There are numerous string serving jigs in the art for wrapping bowstrings. However, it appears none of the prior art string serving jigs provides consistent tension when wrapping a bowstring with severing string or a quick change spool that may be removed from the string serving jig without changing a tension setting on the quick change spool.

Accordingly, there is a clearly felt need in the art for a string serving jig, which provides consistent tension when wrapping a bowstring with serving string and allows a quick change spool to be removed from the string serving jig without changing a tension setting on the quick change spool.

SUMMARY OF THE INVENTION

The present invention provides a string serving jig, which allows a quick change spool to be removed from the string serving jig without changing a tension setting on the quick change spool. The string serving jig preferably includes a frame, a quick change spool, a first spindle, a second spindle and a third spindle. The frame preferably includes a first half frame and a second half frame. The first half frame includes a first base and a first upright portion. The second half frame includes a second base and a second upright portion. A U-shaped slot is formed in a top of each upright portion. Three spindle counterbores are formed in an inside surface of each upright portion to receive flanged bearings. Each quick change spool preferably includes a spool reel, a spool spindle, a spool drive, a drag cup, a plurality of friction washers, a drag cover, a spool lock plate and a spool knob. The spool reel includes a round tubular body and two opposing flanges. The round tubular body is terminated on each end with the two opposing flanges. The spool spindle includes a base rod, a lock shaft and a friction shaft. The friction shaft extends from one end of the base rod and the lock shaft extends from an opposing end of the base rod. A spindle hole is formed through a length of the spool reel to allow insertion of the spool spindle. A friction counterbore is formed in one end of the spindle hole to receive at least one friction bearing for the friction shaft. A lock counterbore is formed in an opposing end of the spool hole to receive a lock bearing.

The spool drive preferably includes a tubular shaft, a flange plate and a pair of drive pins. The tubular shaft extends outward from one side of the flange plate and the pair of drive pins extend outward from an opposing end of the flange plate. An even number of drive holes are formed in one of the two opposing flanges to receive the pair of drive pins. A U-shaped projection is formed on one end of the drag cup, which sized to be received by the U-shaped slot to prevent rotation of the drag cup relative to the frame. The drag cup further includes a bearing bore formed in the U-shaped projection to receive at least one drag bearing and a washer bore formed in an opposing end of the drag cup to receive the plurality of friction washers. The drag cover includes a cup counter bore, which is sized to receive an outer perimeter of the drag cup. A friction thread is formed through a bottom of the cup counter bore to threadably receive a distal end of the friction shaft. The spool lock plate includes a U-shaped projection, which is sized to be received by the U-shaped slot. A through hole is formed through the spool lock plate to provide clearance for the lock shaft. A threaded hole is formed through the spool knob to threadably receive a distal end of the lock shaft. The spool knob is tightened against the second upright portion to prevent rotation of the spool spindle relative to the frame.

The first spindle includes a first string shaft and two first bearing shafts that extend from opposing ends of the first string shaft to receive two first spindle bearings. A narrow groove is formed in a middle of the first string shaft. The first spindle is located closest to the quick change spool. The second spindle includes a second string shaft and two second bearing shafts that extend from opposing ends of the second string shaft to receive two second spindle bearings. A wide groove is formed in a middle of the second string shaft. A center axis of the second spindle is vertically located between the center axis of the first and third spindles. The third spindle is located furthest away from the quick change spool. The third spindle includes a third string shaft and two third bearing shafts that extend from opposing ends of the third string shaft to receive two second spindle bearings. The third string shaft includes a crowned profile.

Accordingly, it is an object of the present invention to provide a string serving jig, which provides consistent tension when wrapping a bowstring with serving string.

Finally, it is another object of the present invention to provide a string serving jig, which allows a quick change spool to be removed from the string serving jig without changing a tension setting on the quick change spool.

These and additional objects, advantages, features and benefits of the present invention will become apparent from the following specification.

DETAILED DESCRIPTION OF THE PREFERRED EMBODIMENTS

Figure 1:
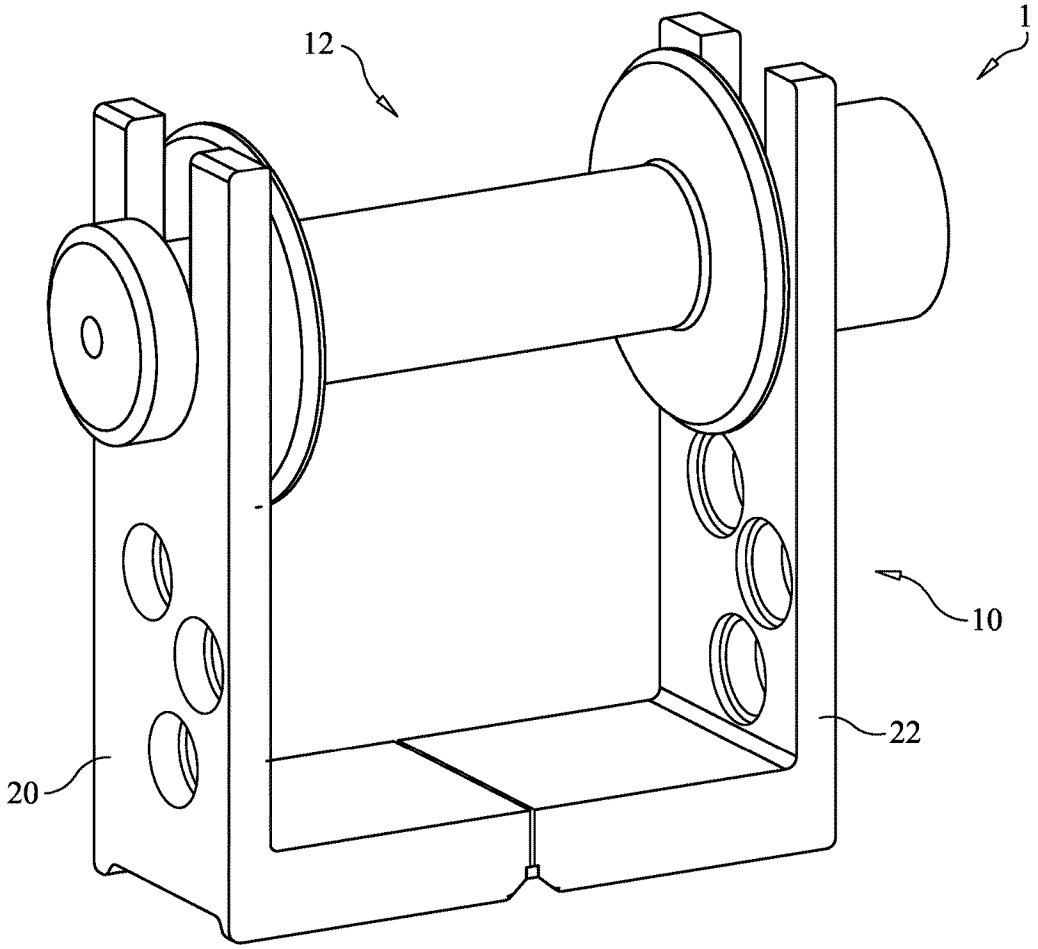
FIG. 1 is a perspective view of a string serving jig without rollers in accordance with the present invention.
Figure 2:
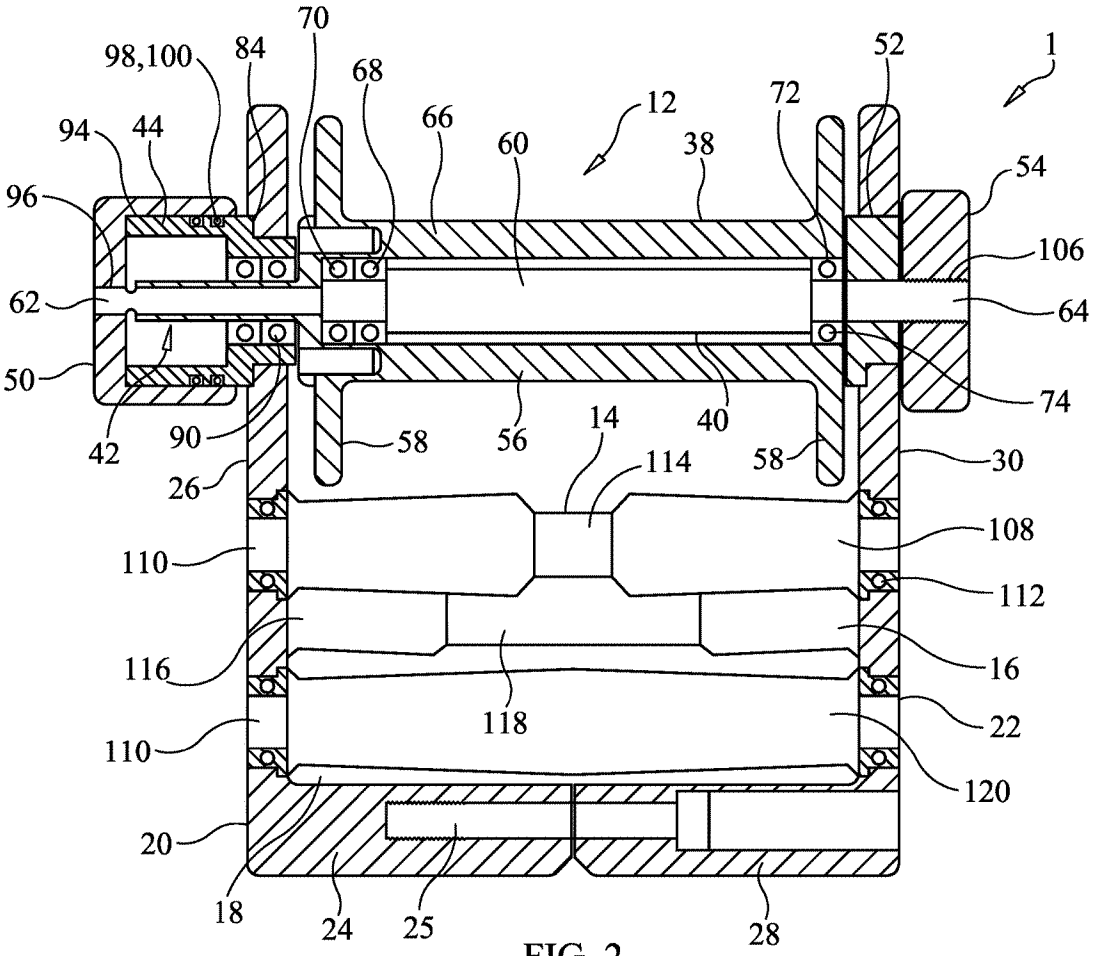
FIG. 2 is a cross sectional view of a string serving jig in accordance with the present invention.
Figure 4:
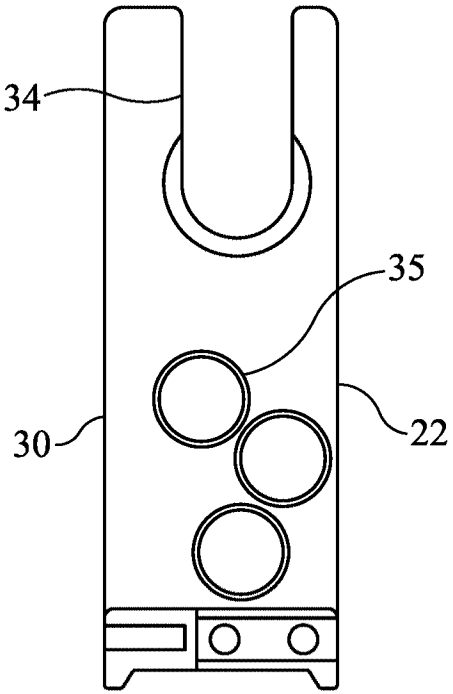
FIG. 4 is an inside side view of a second frame half of a string serving jig in accordance with the present invention.
Figure 3:
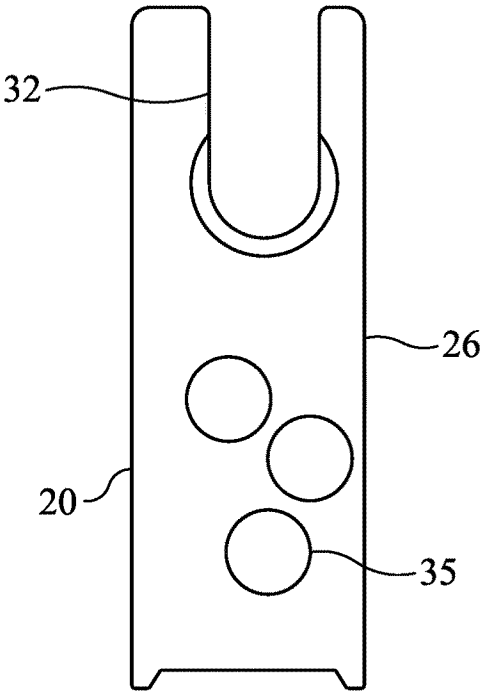
FIG. 3 is an outside side view of a first frame half of a string serving jig in accordance with the present invention.
Figure 7:
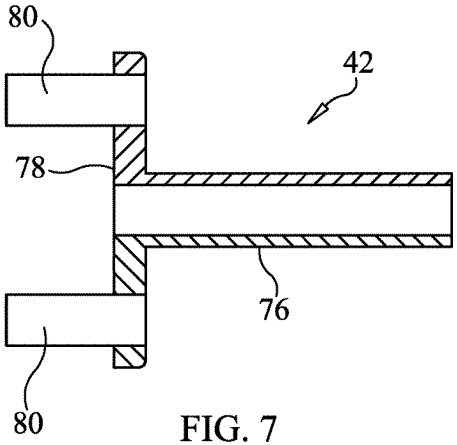
FIG. 7 is a front view of a spool drive of a string serving jig in accordance with the present invention.
Figure 9:
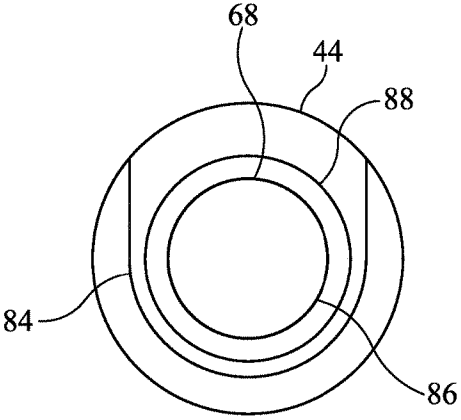
FIG. 9 is a second end view of a drag cup of a string serving jig in accordance with the present invention.
Figure 6:
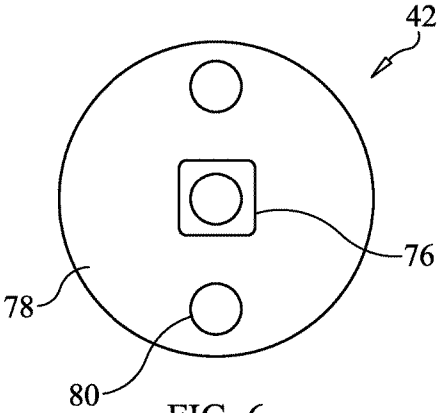
FIG. 6 is an end view of a spool drive of a string serving jig in accordance with the present invention.
Figure 8:
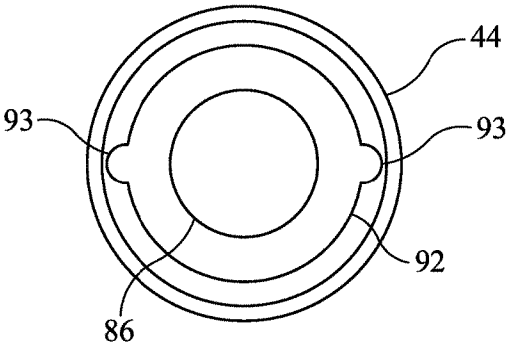
FIG. 8 is a first end view of a drag cup of a string serving jig in accordance with the present invention.
Figure 10:
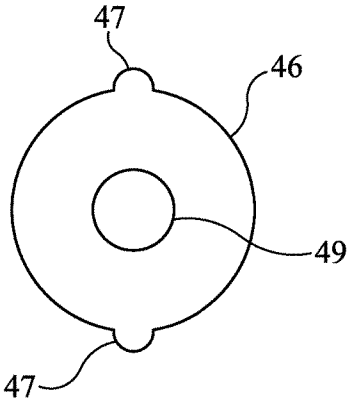
FIG. 10 is a top view of a non-rotating washer of a string serving jig in accordance with the present invention.
Figure 11:
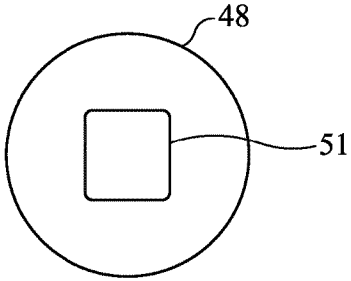
FIG. 11 is a top view of a rotating washer of a string serving jig in accordance with the present invention.
Figure 12:
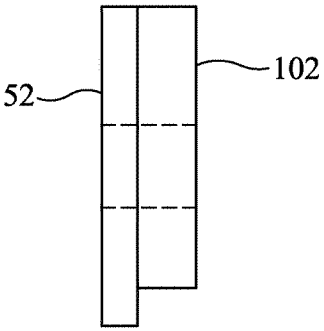
FIG. 12 is a side view of a spool lock plate of a string serving jig in accordance with the present invention.
Figure 13:
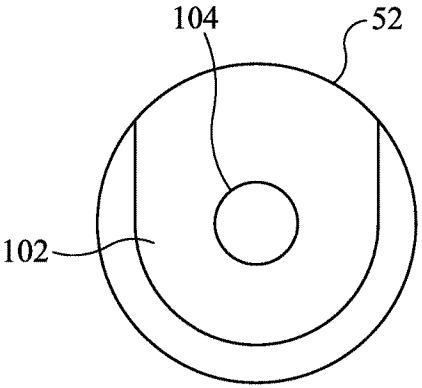
FIG. 13 is an end view of a spool lock plate of a string serving jig in accordance with the present invention.

With reference now to the drawings, and particularly to FIG. 1, there is shown a perspective view of a string serving jig 1 without rollers. With reference to FIG. 2, the string serving jig 1 preferably includes a frame 10, a quick change spool 12, a first spindle 14, a second spindle 16 and a third spindle 18. The frame 10 preferably includes a first half frame 20 and a second half frame 22. The first half frame 20 includes a first base 24 and a first upright portion 26. The second half frame includes a second base 28 and a second upright portion 30. The first base 24 is preferably attached to the second base 28 with at least two fasteners 25. With reference to FIGS. 3-4, a first U-shaped slot 32 is formed in a top of the first upright portion 26. A second U-shaped slot 34 is formed in a top of the second upright portion 30. Three spindle counterbores 35 are formed in an inner surface of each upright portion 26, 30 to receive flanged bearings 36.

With reference to FIGS. 6-13, each quick change spool 12 preferably includes a spool reel 38, a spool spindle 40, a spool drive 42, a drag cup 44, a plurality of friction washers 46, 48, a drag cover 50, a spool lock plate 52 and a spool knob 54. A quantity of serving string (not shown) is retained on the spool reel 38. The spool reel 38 includes a round tubular body 56 and two opposing flanges 58. The round tubular body 56 is terminated on each end with the two opposing flanges 58. The spool spindle 40 includes a base rod 60, a friction shaft 62 and a lock shaft 64. The friction shaft 62 extends from one end of the base rod 60 and the lock shaft 64 extends from an opposing end of the base rod 60. A spindle hole 66 is formed through a length of the spool reel 38 to allow insertion of the spool spindle 40. A friction bearing counterbore 68 is formed in one end of the spindle hole 66 to receive a friction bearing 70 for the friction shaft 62. A lock counterbore 72 is formed in an opposing end of the spool hole 66 to receive at least one lock bearing 74.

Figure 5:
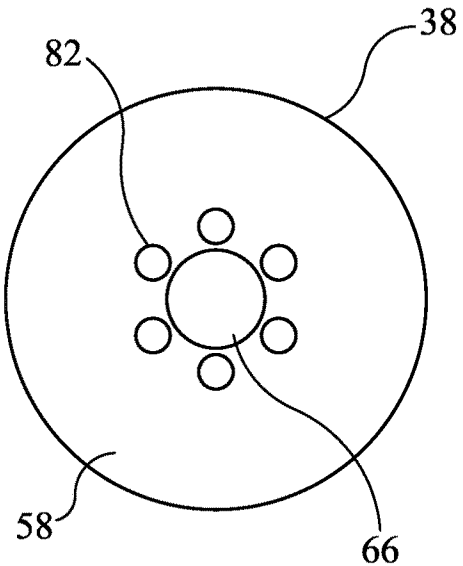
FIG. 5 is an end view of a spool reel of a string serving jig in accordance with the present invention.

The spool drive 42 preferably includes a square tubular shaft 76, a flange plate 78 and a pair of drive pins 80. The square tubular shaft 76 extends outward from one side of the flange plate 78 and the pair of drive pins 80 extend outward from an opposing end of the flange plate 78. With reference to FIG. 5, an even number of drive holes 82 are formed in one of the two opposing flanges 58 to receive the pair of drive pins 80. A U-shaped projection 84 is formed on one end of the drag cup 44, which sized to be received by the first U-shaped slot 32 to prevent rotation of the drag cup 44 relative to the frame 10. The drag cup 44 further includes a bearing bore 86 formed in the U-shaped projection 84 and a hub 88 to receive at least one drag bearing 90. A washer bore 92 is formed in an opposing end of the drag cup 44 to receive the plurality of non-rotating friction washers 46 and the plurality of rotating washers 48. Each non-rotating washer 46 includes a pair of opposing projections 47, which are sized to be received by a pair of opposing cavities 93 formed in the side wall of the washer bore 92. A shaft clearance hole 49 is formed through each non-rotating washer 46 to provide clearance for the square tubular shaft 76. Each rotating friction washer 48 includes a square hole 51, which is sized to receive the square tubular shaft 76. The plurality of non-rotating friction washers 46 are alternated between the plurality of rotating friction washers 48.

The drag cover 50 includes a cup counterbore 94, which is sized to receive an outer perimeter of the drag cup 44. A friction thread 96 is formed through a bottom of the cup counterbore 94 to threadably receive a threaded distal end of the friction shaft 62. At least one o-ring groove 98 is formed in an outer perimeter of the drag cup 44 to receive at least one o-ring 100. The at least one o-ring 100 provides frictional engagement between the drag cup 44 and the drag cover 50. The at least one o-ring 100 also prevents friction grease applied to between the friction washers 46, 48 from leaving the washer bore 92. The spool lock plate 52 includes a U-shaped projection 102, which is sized to be received by the second U-shaped slot 34. A through hole 104 is formed through the spool lock plate 52 to provide clearance for the lock shaft 62. A threaded hole 106 is formed through the spool knob 54 to threadably receive a threaded distal end of the lock shaft 62. The spool knob 54 is tightened against the second upright portion 30 to prevent rotation of the spool spindle 40 relative to the frame 10. The spool reel 38 may be removed from the frame 10 by unthreading the spool knob 54 from the lock shaft 64; pulling the quick change spool 12 upward out of the first and second U-shaped slots 32, 34; and withdrawing spool spindle 40 from the spool reel 38 without changing a tension setting in the drag cup 44.

The first spindle 14 includes a first string shaft 108 and two first bearing shafts 110 that extend from opposing ends of the first string shaft 108 to receive two first spindle bearings 112. A narrow groove 114 is formed in a middle of the first string shaft 108. The first spindle 14 is located closest to the quick change spool 12. The second spindle 16 includes a second string shaft 116 and two second bearing shafts (not shown) that extend from opposing ends of the second string shaft 116 to receive two second spindle bearings 112. A wide groove 118 is formed in a middle of the second string shaft 116. A center axis of the second spindle 16 is vertically located between the center axis of the first and second spindles 14, 18. The third spindle 18 includes a third string shaft 120 and two third bearing shafts 110 that extend from opposing ends of the third string shaft 120 to receive two second spindle bearings 112. The third string shaft 120 includes a crowned profile. The third spindle 18 is located furthest away from the quick change spool 12.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A string serving jig comprising:

a frame having a first upright portion and a second upright portion;

a spool reel includes two opposing flanges and an inner diameter;

a spool spindle includes a friction shaft disposed on one end and a lock shaft disposed on an opposing end, said spool spindle is rotatably retained in said inner diameter, said lock shaft is retained in said second upright portion such that said spool spindle does not rotate relative to said frame;

a spool drive includes a tubular shaft and a flange plate, said tubular shaft extends from one side of said flange plate, an opposing side of said flange plate drives said spool reel, said friction shaft is inserted through said tubular shaft;

a plurality of rotating friction washers are retained on said tubular shaft;

a plurality of non-rotating washers;

a drag cup includes a washer bore, said plurality of non-rotating friction washers are retained in said washer bore, said drag cup is retained in said second upright portion; and a drag cover is threaded on to said friction shaft, wherein said drag cover is capable of exterting force against said plurality of friction washers, said plurality of friction washers cause said spool reel to resist rotation.

2. The string serving jig of claim 1 wherein:

two drive pins extend from an opposing side of said flange plate; and an even number of holes are formed in one of said two opposing flanges to receive said two drive pins.

3. The string serving jig of claim 1 wherein:

said tubular shaft includes a square cross section, each one of said plurality of rotating friction washers includes a square hole to receive said tubular shaft.

4. The string serving jig of claim 1 wherein:

each one of said plurality of non-rotating friction washers includes a pair of opposing projections, a pair of opposing cavities are formed in a side wall of said washer bore to receive said pair of opposing projections.

5. The string serving jig of claim 1, further comprising:

a spool lock plate is retained in said second upright portion, said lock shaft is inserted through said spool lock plate, said spool lock plate does not rotate relative to said second upright portion.

6. The string serving jig of claim 1, further comprising:

a spool knob is tightened on a threaded end of said lock shaft to prevent rotation of said spool spindle.

7. A string serving jig comprising:

a frame having a first upright portion and a second upright portion;

a spool reel includes two opposing flanges and an inner diameter;

a spool spindle includes a friction shaft disposed on one end and a lock shaft disposed on an opposing end, said spool spindle is rotatably retained in said inner diameter, said lock shaft is retained in said second upright portion such that said spool spindle does not rotate relative to said frame;

a spool drive includes a tubular shaft and a flange plate, said tubular shaft extends from one side of said flange plate, an opposing side of said flange plate drives said spool reel, said friction shaft is inserted through said tubular shaft;

a plurality of rotating friction washers are retained on said tubular shaft;

a plurality of non-rotating washers;

a drag cup includes a washer bore, said plurality of non-rotating friction washers are retained in said washer bore, said drag cup is retained in said first upright portion;

a drag cover is threaded on to said friction shaft, wherein said drag cover is capable of exterting force against said plurality of friction washers, said plurality of friction washers cause said spool reel to resist rotation; and a plurality of spindles are rotatably retained between said first and second upright portions.

8. The string serving jig of claim 7 wherein:

said plurality of spindles includes a first spindle, a second spindle and a third spindle; and two drive pins extend from an opposing side of said flange plate.

9. The string serving jig of claim 8 wherein:

an even number of holes are formed in one of said two opposing flanges to receive said two drive pins.

10. The string serving jig of claim 7 wherein:

said tubular shaft includes a square cross section, each one of said plurality of rotating fiction washers includes a square hole to receive said tubular shaft.

11. The string serving jig of claim 7 wherein:

each one of said plurality of non-rotating friction washers includes a pair of opposing projections, a pair of opposing cavities are formed in a side wall of said washer bore to receive said pair of opposing projections.

12. A string serving jig comprising:

a frame having a first upright portion and a second upright portion, said first upright portion includes a first slot, said second upright portion includes a second slot;

a spool reel includes two opposing flanges and an inner diameter;

a spool spindle includes a friction shaft disposed on one end and a lock shaft disposed on an opposing end, said spool spindle is rotatably retained in said inner diameter, said lock shaft is retained in said second upright portion such that said spool spindle does not rotate relative to said frame;

a spool drive includes a tubular shaft and a flange plate, said tubular shaft extends from one side of said flange plate, an opposing side of said flange plate drives said spool reel, said friction shaft is inserted through said tubular shaft;

a plurality of rotating friction washers are retained on said tubular shaft;

a plurality of non-rotating friction washers a drag cup includes a washer bore, said plurality of non-rotating friction washers are retained in said washer bore, said drag cup is retained in said first slot;

a drag cover is threaded on to said friction shaft, wherein said drag cover is capable of exterting force against said plurality of friction washers, said plurality of friction washers cause said spool reel to resist rotation.

13. The string serving jig of claim 12 wherein:

said plurality of non-rotating friction washers are alternated with said plurality of rotating friction washers.

14. The string serving jig of claim 12 wherein:

two drive pins extend from an opposing side of said flange plate; and an even number of holes are formed in one of said two opposing flanges to receive said two drive pins.

15. The string serving jig of claim 12 wherein:

said tubular shaft includes a square cross section, each one of said plurality of rotating fiction washers includes a square hole to receive said tubular shaft.

16. The string serving jig of claim 12 wherein:

each one of said plurality of non-rotating friction washers includes a pair of opposing projections, a pair of opposing cavities are formed in a side wall of said washer bore to receive said pair of opposing projections.

17. The string serving jig of claim 12, further comprising:

a spool lock plate is retained in said second upright portion, said lock shaft is inserted through said spool lock plate, said spool lock plate does not rotate relative to said second upright portion.

18. The string serving jig of claim 12, further comprising:

a spool knob is tightened on a threaded end of said lock shaft to prevent rotation of said spool spindle.

* * * * *